US008556003B2

(12) United States Patent
Souchek

(10) Patent No.: US 8,556,003 B2
(45) Date of Patent: Oct. 15, 2013

(54) SPLIT SUB-BASEMENT DRILL RIG

(75) Inventor: Richard Dwaine Souchek, Richmond, TX (US)

(73) Assignee: National Oilwell Varco, L.P., Houston, TX (US)

( * ) Notice: Subject to any disclaimer, the term of this patent is extended or adjusted under 35 U.S.C. 154(b) by 353 days.

(21) Appl. No.: 12/947,006

(22) Filed: Nov. 16, 2010

(65) Prior Publication Data

US 2011/0114386 A1 May 19, 2011

Related U.S. Application Data

(60) Provisional application No. 61/262,232, filed on Nov. 18, 2009.

(51) Int. Cl.
*E21B 19/08* (2006.01)
*E04H 12/24* (2006.01)
*E04G 1/18* (2006.01)

(52) U.S. Cl.
USPC ..... 175/162; 175/203; 182/141; 52/123.1; 52/126.6

(58) Field of Classification Search
USPC ..... 175/52, 162, 203; 182/141; 52/111, 52/122.1, 123.1, 126.6
See application file for complete search history.

(56) References Cited

U.S. PATENT DOCUMENTS 233,788 A * 10/1880 Mitchell ..... 182/141
2,857,993 A 10/1958 Terrell ..... 189/11
2,922,533 A * 1/1960 La Barge, Jr. ..... 414/746.7
3,161,259 A 12/1964 Wilson ..... 182/141
3,922,825 A 12/1975 Eddy et al. ..... 52/116
3,983,960 A * 10/1976 Sikli ..... 187/269
4,021,978 A 5/1977 Busse et al. ..... 52/118
4,024,924 A 5/1977 Houck ..... 173/151
4,135,340 A 1/1979 Cox et al. ..... 52/115
4,269,009 A 5/1981 Lawrence ..... 52/116
4,368,602 A 1/1983 Manten ..... 52/115
4,371,041 A 2/1983 Becker et al. ..... 173/28
4,375,241 A 3/1983 Gallon ..... 173/151
4,473,977 A 10/1984 Reed ..... 52/116
4,478,015 A 10/1984 Lawrence et al. ..... 52/120
4,489,526 A 12/1984 Cummins ..... 52/125.6
4,569,168 A 2/1986 McGovney et al. ..... 52/122.1
4,630,425 A 12/1986 Reed ..... 52/745
4,759,414 A 7/1988 Willis ..... 175/170
4,821,816 A 4/1989 Willis ..... 175/57

(Continued)

FOREIGN PATENT DOCUMENTS

SU 901502 B * 2/1982

*Primary Examiner* — Jennifer H Gay
(74) *Attorney, Agent, or Firm* — Williams, Morgan & Amerson, P.C.

(57) ABSTRACT

A substructure of a drill rig includes, among other things, a base and an intermediate section that is adapted to be raised above the base, wherein the intermediate section is further adapted to be laterally moved in a first lateral direction relative to the base and maintained substantially parallel to the base during the raising of the intermediate section above the base. The substructure further includes a rig floor section that is adapted to be raised above the intermediate section, wherein the rig floor section is further adapted to be laterally moved in a second lateral direction relative to the base and maintained substantially parallel to the base during the raising of the rig floor section above the intermediate section, the second lateral direction being opposite to the first lateral direction.

28 Claims, 5 Drawing Sheets

(56) References Cited

U.S. PATENT DOCUMENTS

| | | | | | |
|---|---|---|---|---|---|
| 4,831,795 | A | | 5/1989 | Sorokan | 52/120 |
| 4,899,832 | A | | 2/1990 | Bierscheid, Jr. | 173/23 |
| 5,109,934 | A | | 5/1992 | Mochizuki | 175/170 |
| 5,445,489 | A | * | 8/1995 | Evans et al. | 414/458 |
| 5,569,013 | A | * | 10/1996 | Evans et al. | 414/458 |
| 5,755,296 | A | | 5/1998 | Richardson et al. | 175/162 |
| 5,794,723 | A | | 8/1998 | Caneer, Jr. et al. | 175/85 |
| 6,024,181 | A | | 2/2000 | Richardson et al. | 175/162 |
| 6,070,699 | A | * | 6/2000 | Bleeker | 187/240 |
| 6,634,436 | B1 | | 10/2003 | Desai | 173/1 |
| 6,848,515 | B2 | | 2/2005 | Orr et al. | 173/1 |
| 6,860,337 | B1 | | 3/2005 | Orr et al. | 173/28 |
| 6,994,171 | B2 | | 2/2006 | Orr et al. | 173/28 |
| 7,308,953 | B2 | | 12/2007 | Barnes | 175/203 |
| 7,497,052 | B2 | | 3/2009 | Hu | 52/111 |
| 8,250,816 | B2 | * | 8/2012 | Donnally et al. | 52/123.1 |
| 2003/0051915 | A1 | | 3/2003 | Brittain et al. | 175/52 |
| 2004/0211598 | A1 | | 10/2004 | Palidis | 175/162 |
| 2006/0027373 | A1 | | 2/2006 | Carriere et al. | 166/379 |
| 2008/0164064 | A1 | | 7/2008 | Belik et al. | 175/52 |
| 2009/0000218 | A1 | | 1/2009 | Lee et al. | 52/123.1 |
| 2009/0071720 | A1 | | 3/2009 | Cowan | 175/57 |
| 2009/0188677 | A1 | | 7/2009 | Ditta et al. | 166/382 |
| 2009/0200856 | A1 | | 8/2009 | Chehade et al. | 299/30 |
| 2009/0218144 | A1 | | 9/2009 | Donnally et al. | 175/162 |
| 2009/0283324 | A1 | * | 11/2009 | Konduc et al. | 175/57 |
| 2011/0072737 | A1 | * | 3/2011 | Wasterval | 52/115 |
| 2011/0114386 | A1 | * | 5/2011 | Souchek | 175/52 |

* cited by examiner

SPLIT SUB-BASEMENT DRILL RIG

This application claims priority from U.S. provisional patent application Ser. No. 61/262,232, filed on Nov. 18, 2009, which is incorporated herein by reference.

BACKGROUND OF THE INVENTION

1. Field of the Invention

This invention relates to road-transportable drill rigs for drilling boreholes into the earth to extract hydrocarbons, such as oil and natural gas, as well as other minerals.

2. Description of the Related Art

Drilling masts are the vertical structures used to support the drill string while a well is being drilled. Masts are usually rectangular in shape as opposed to the generally pyramidal shape of a derrick. The rectangular shape offers very good stiffness that allows the mast to be moved to a horizontal position for transport. Thus, drilling masts are very common on portable land rigs.

FIG. 1A shows a mast assembly 120 for a transportable (i.e. portable) drill rig 100 of the prior art, but which has many components in common with the present invention. The mast assembly 120 has a derrick 112, an A-frame 114, as part of the rig structure 120, on a rig floor 116 mounted to a substructure 118. The mast 120 is pivotally connected to the floor 116. The mast 120 is a typical drilling rig mast with top sheaves (not shown). The rig floor of this prior art drill rig is supported upon a base 122 with conventional cross-bracing members 118, 118*a*, and 118*b* which brace the rig during operation. Typical components of these rigs 100 also include drawworks 130, a control system 134 and other machinery well known and commonly used in the industry.

The rigs also typically have a number of structural members (140A, 140B & 140C) that carry the load of the rig 100 as it stands upright. However, since these rigs are portable, they are made to be collapsible during transport, and are therefore typically raised from a stacked/collapsed position with a wire rope system using the existing drawworks 130 system of the rig through a series of pulleys, or by hydraulic cylinders. Very high tension loads are applied to the wire rope during assembly, and a relatively complex series of pulleys, etc. may be required to raise the rig floor. It would be preferable to utilize a more easily controlled lifting system that did not require a cabling system carrying high tensile loads to raise these rig floors.

BRIEF SUMMARY OF THE INVENTION

The present invention provides a sub-basement assembly for transportable, mobile drill rigs for supporting the drill rig floor. The assembly has a lower 'stack' height for transit but which can nonetheless be quickly and easily raised with a hydraulic cylinder as the substructure is erected. Although the height & size of the present invention's 'floor' is quite compact while in shipment, it provides for the full load carrying capacity and full size of conventional 'floors' during drilling operations. The linkage structure provides the ability for the rig floor to be raised with a hydraulic cylinder with the linkage then locked in place as part of the fig floor support structure.

DETAILED DESCRIPTION OF THE INVENTION

Figure 1A:
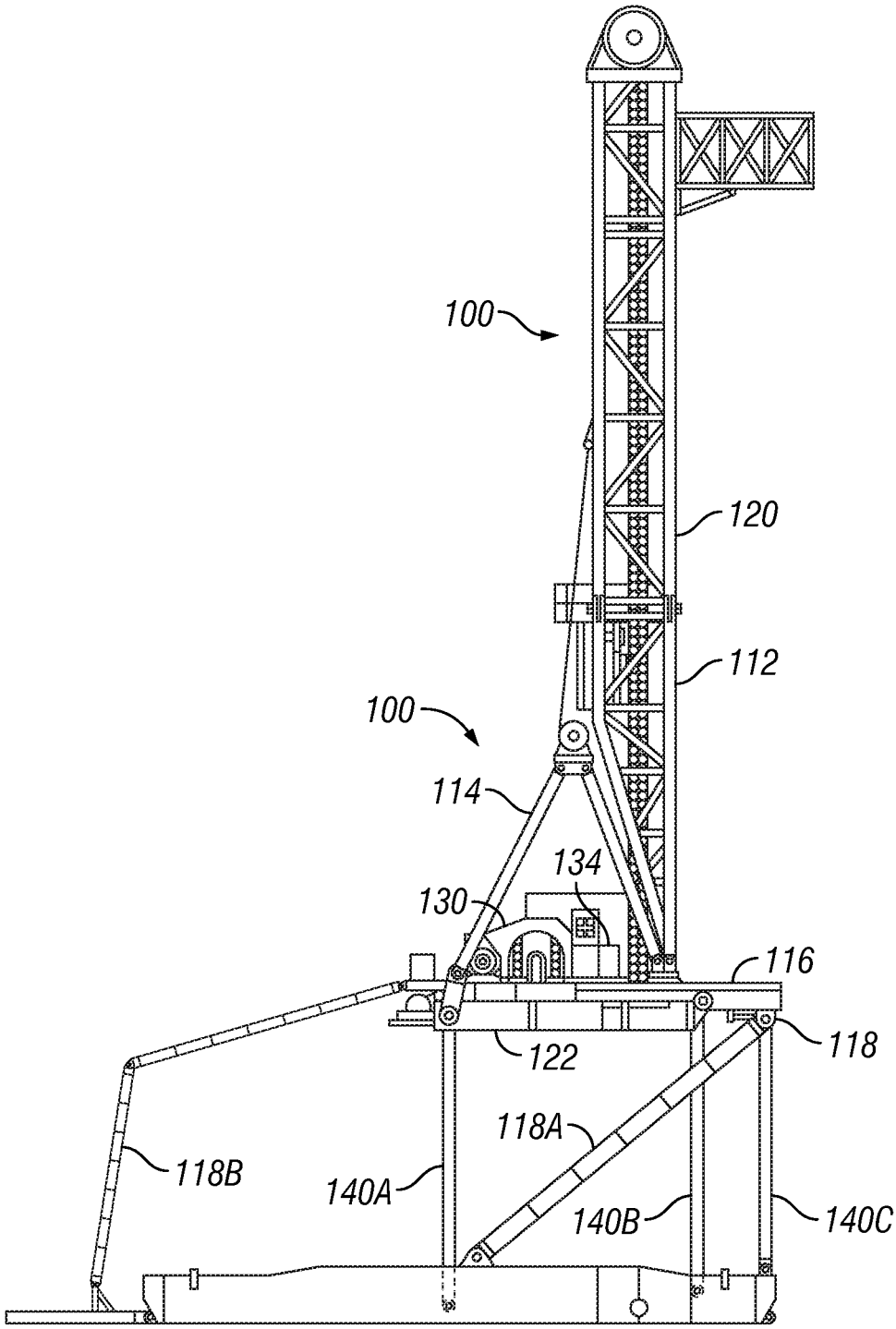
FIG. 1A (Prior Art)
FIG. 1A is a side view of a prior art drill rig.
Figure 1B:
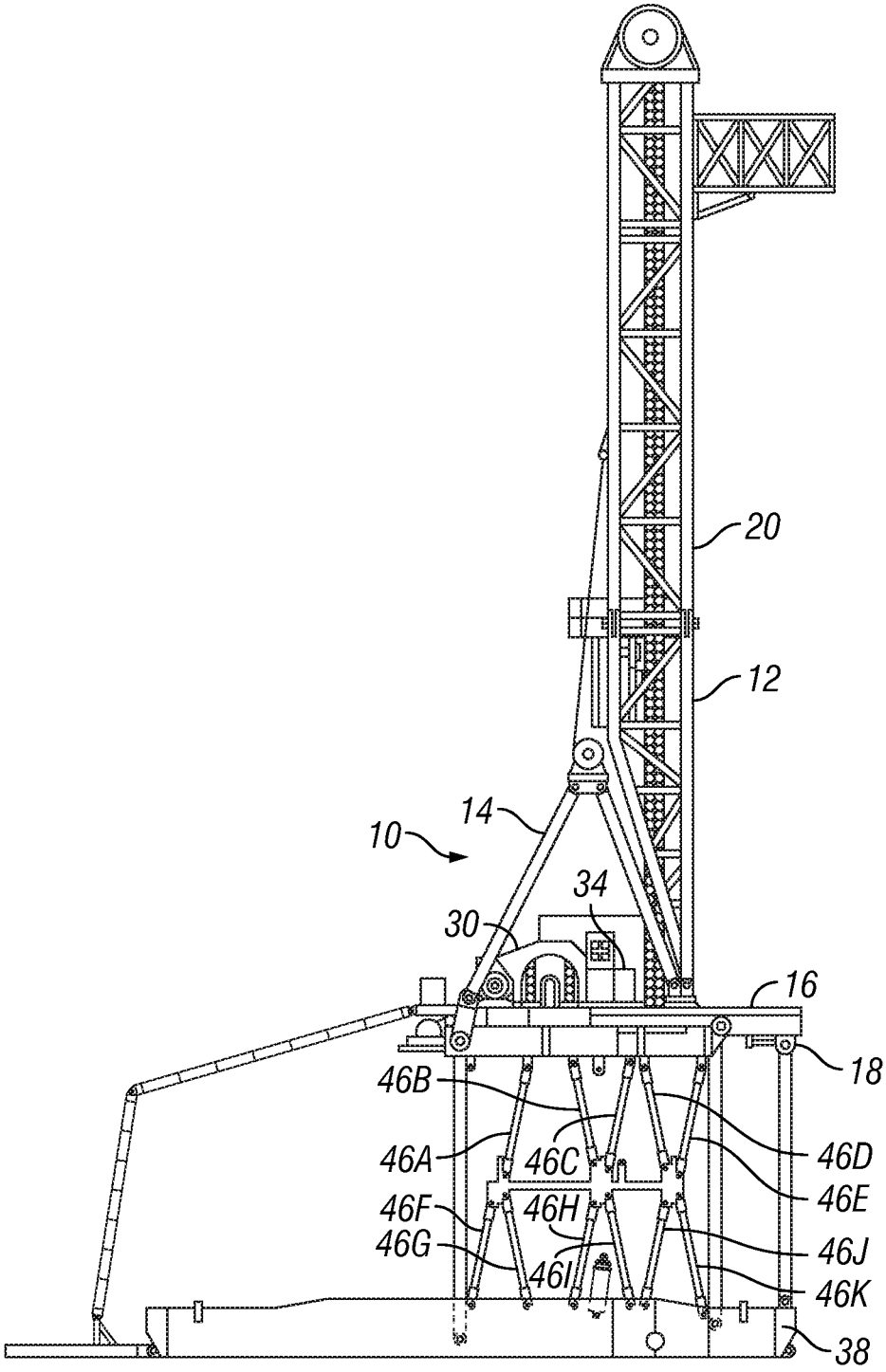
FIG. 1B is a side view of a drill rig of the present invention, showing the support structure under the drill rig floor.

Referring now to FIG. 1B, the drill rig 10 of the present invention includes a mast assembly 20 and many other components for a transportable (i.e. portable) drill rig 100 known in the prior art, and therefore has many components in common with the present invention. The mast assembly 20 of the present invention includes a mast 12, an A-frame 14, as part of the rig 10, on a floor 16 mounted to a substructure 18. The mast 12 is pivotally connected to the floor 16. The mast 12 is a typical drilling rig mast with top sheaves (not shown). The rig floor 16 is supported upon the substructure 18 which is carried by the pivotable cross bracing links 46*a*, 46*b*, 46*c*, 46*d*, 46*e*, 46*f*, 46*g*, 46*h*, 46*i*, 46*j*, and 46*k* of the present invention. Other components of the rig 10 may include drawworks 30, a control system 34 and other machinery well known and commonly used in the industry.

Figure 2A:
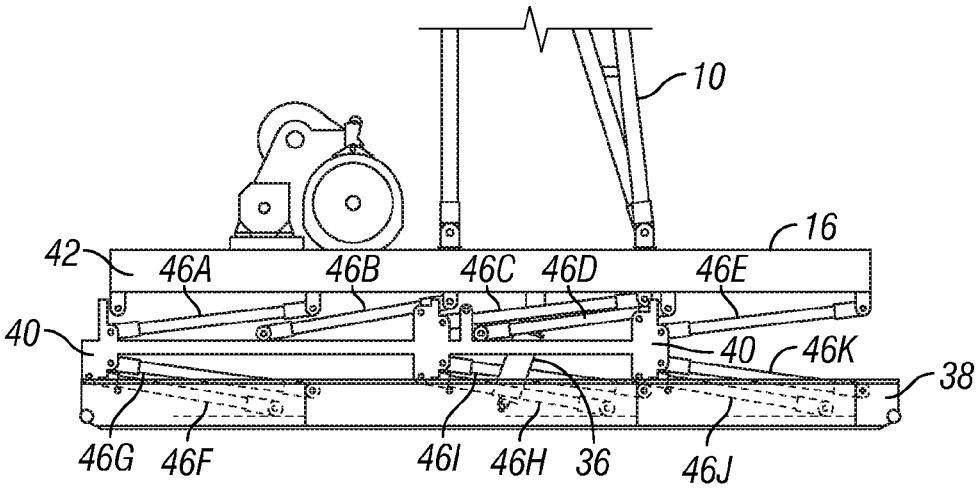
FIG. 2A is a side view of the basement structure of the present invention when the floor is fully collapsed.
Figure 2B:
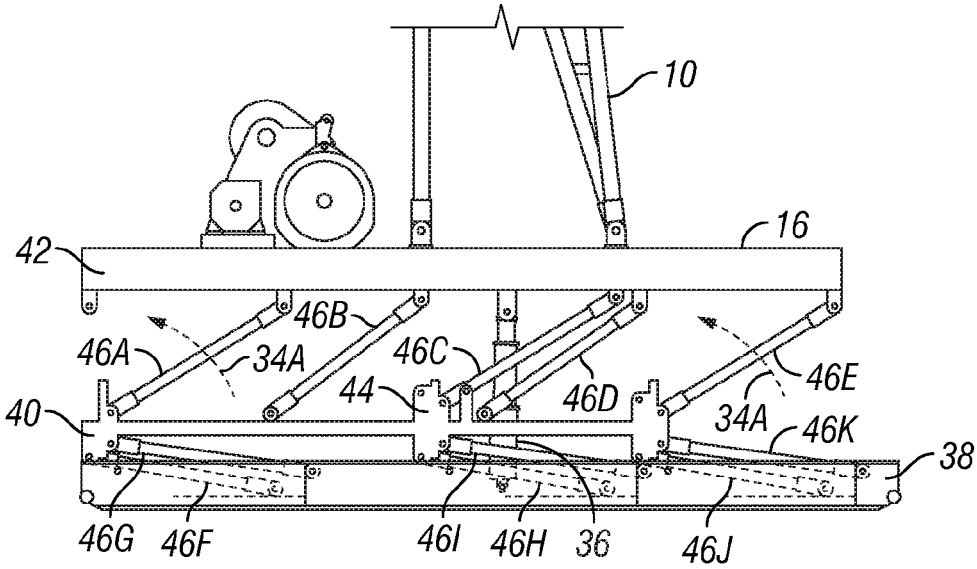
FIG. 2B is a side view of the basement structure of the present invention when the floor is raised to about 15% of its height.
Figure 2C:
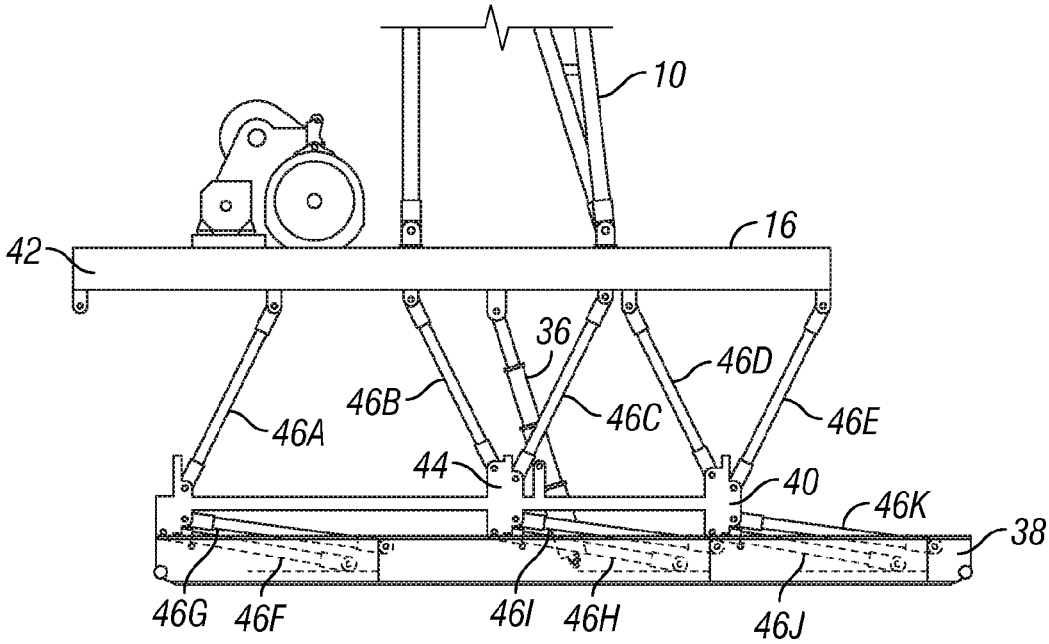
FIG. 2C is a side view of the basement structure of the present invention when the floor is raised to about 50% of its height, showing the upper struts fully extended.
Figure 2D:
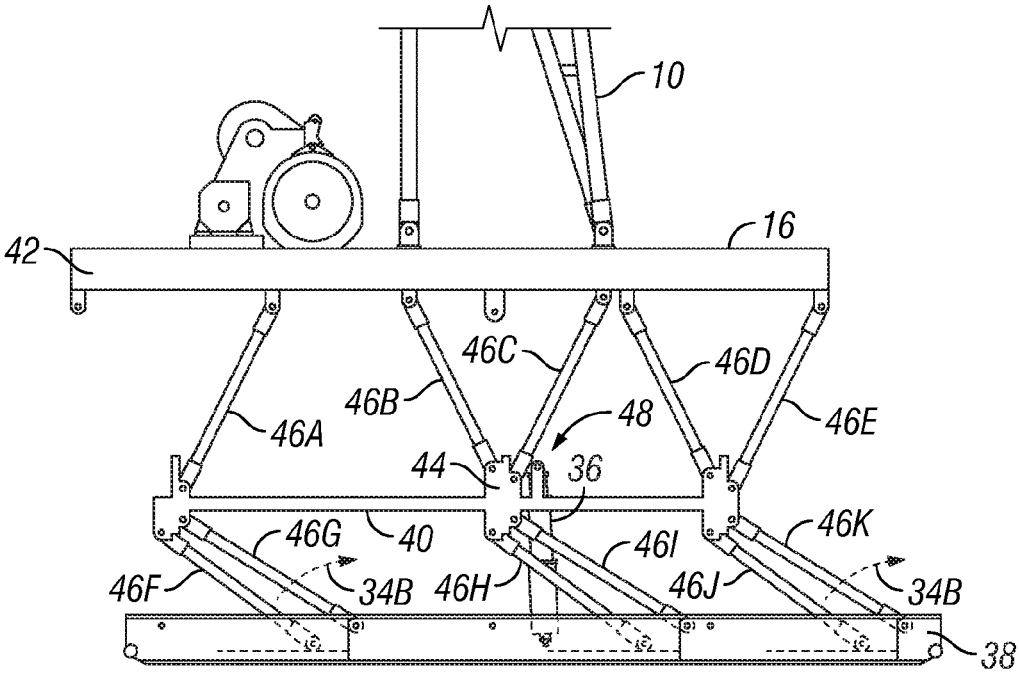
FIG. 2D is a side view of the basement structure of the present invention when the floor is raised to about 75% of its height.
Figure 2E:
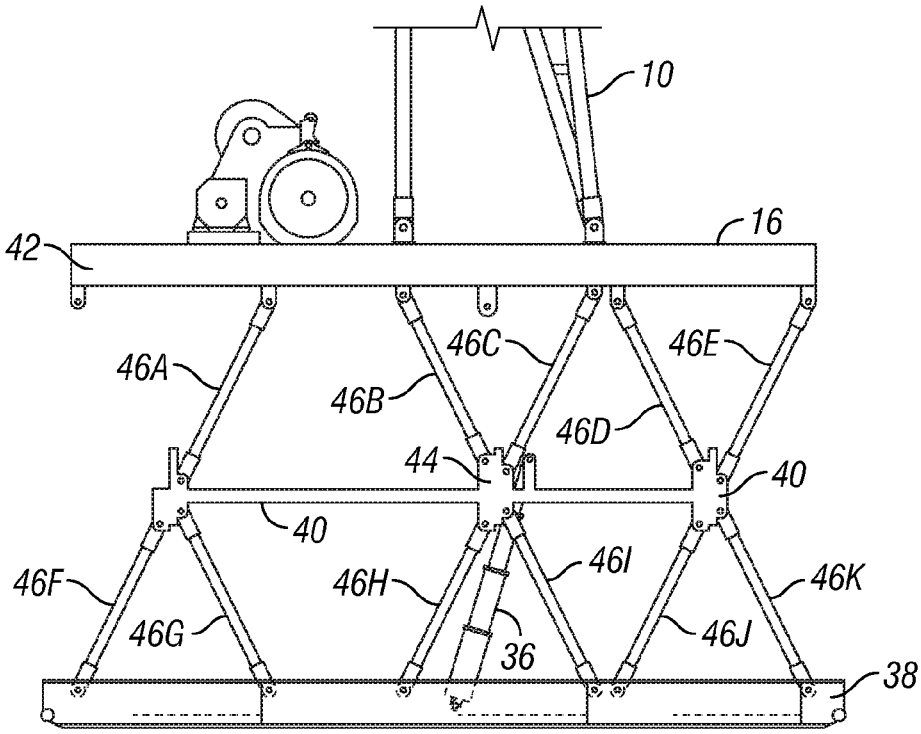
FIG. 2E is a side view of the basement structure of the present invention when the floor is fully raised.

The drill rig 10 is provided with a rig floor 16 elevating system which allows it to be raised from the shipping/stowed collapsed position as illustrated generally by FIG. 2A to the full operation position height as illustrated generally by FIG. 2E.

While drill rigs of the prior art typically utilized flexible tension members, such as wire rope spooled on winches to provide the force required to raise the rig floor, the present invention uses a hydraulic cylinder 36 operating in compression to raise the rig floor in two or more stages. Generally, however, as will be seen, an even number of stages are preferred, although it is clear that having an odd numbers of stages is clearly within the scope of the present invention.

There is no particular order for raising the intermediate center section 40, 44 and the rig floor section 42, so for convenience only, the raising process will be described with the rig floor section 42 being raised first, and the intermediate carrier section 40, being raised second, from the rig base 38.

In preparation for the first stage of the lifting operation, the hydraulic cylinder 36 is restrained at the base 38 and the rig floor section 42. Although not necessarily a requirement, the linkages 46*f*, 46*g*, 46*h*, 46*i*, 46*j*, and 46*k* may be locked in place to prevent the intermediate center section 40 from inadvertently lifting as the rig floor 16 portion is lifted.

The hydraulic cylinder 36 is then arranged to be connect between the base 38 and the rig floor 16, to push the rig floor 16 upwards from the intermediate center section 40.

As shown in more detail in FIGS. 2A, 2B and 2C, the pivotable links (46*a*, 46*c* and 46*e*) are pinned, or otherwise restrained between the rig floor 16 and the intermediate center section 40. As the hydraulic cylinder 36 extends progressively as shown sequentially in FIGS. 2A, 2B and 2C, the pivotal rotation movement 34*a* of each of the links 46*a*, 46*c*, and 46*e*, and the horizontal movement of the rig floor 16 with respect to the base is evident. As is clear from the FIG. 2C, when the floor section 16 is fully extended from the intermediate center section 40, it is shifted a noticeable distance to the left, as viewed. As will be seen, however, this shifting at the intermediate stage will be compensated by a near equal rightward shift as the intermediate center section 40 is extended from the rig base 38. Once the rig floor 16 is fully extended above the intermediate center section 40, the links 46*b* and 46*d* are re-arranged in a manner such the rig floor section 42 is locked in an extended position with respect to the intermediate center section 40.

Also notable in this view, is that the floor section 16 is moved leftward to its maximum distance from center. As previously stated, this lateral movement is compensated as intermediate center section 40 traverses in the opposite direction as the second stage of the lift progresses.

The second stage of the lifting process is an 'opposing' lift—i.e. the top structure moves sideways in the opposite direction (i.e. left to right as the figure is viewed) back to near centered as shown in FIGS. 2D and 2E. In order to lift the intermediate center section 40 from the base 38, it is first necessary to re-locate the hydraulic cylinder 36 to be pinned or restrained in some manner on one end to the base 38 and on the other end to the intermediate center section 40, as shown generally by arrow 48 in FIG. 2D.

Again the cylinder is extended until the intermediate center section 40 is fully extended from the base 38 as the links 46*g*, 46*i*, and 46*k* are pivotally rotated as indicated at 34*b*. In a manner similar to that described above, links 46*f*, 46*h* and 46*g* are then re-arranged, or new links added, to lock the intermediate center section 40 in place with respect to both the base 38 and the rig floor 42—as shown in FIG. 2*e*.

Because the assemblies shift laterally during extension, an even number of opposing stages, as illustrated, are preferred. It would be appreciated by those skilled in the art, however, that odd numbers of stages may be used as well, especially if the extensions of some stages are significantly greater than others—or if the equipment arrangement on the rig floor causes more load on one side than the other.

Figure 3:
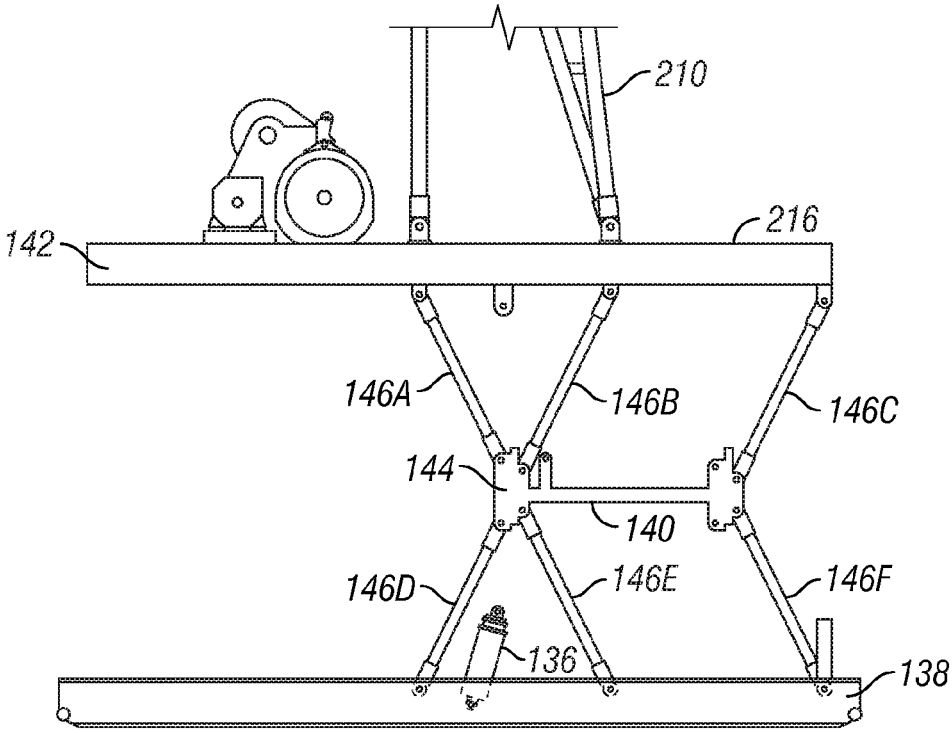
FIG. 3 is a side view of a basic arrangement of the linkage arrangement for the basement structure of the present invention

The structure shown in FIGS. 2A-2E reflect one typical arrangement useful for raising relatively large drilling rigs 10. However, the basic linkage required for the self-raising basement structure as disclosed herein, may be significantly simpler, as shown in FIG. 3. A minimal basement structure is shown in FIG. 3, which nonetheless performs in the same manner as the more elaborate structure illustrated in FIGS. 2A-2E.

In FIG. 3, similar elements between the typical size drill rig 10 of the present invention as shown in FIGS. 2A-2E are illustrated in the 'minimal' rig arrangement 210 but with the identification numerals increased by 100.

The drill rig 210 of this 'minimal' embodiment is provided with a rig floor 216 elevating system which allows it to be raised from the shipping/stowed collapsed position similar to FIG. 2A to its full operation position height.

Again, there is no particular order for raising the intermediate center section 140 and the rig floor section 142 so again for convenience only, the raising process will be described with the rig floor section 142 being raised first, and the intermediate carrier section 140, 144, being raised second, from the rig base 138. Furthermore, for convenience the lifting process described below is described showing the rig floor 216 extended its full height, so all the elements may be clearly viewed.

In preparation for the first stage of the lifting operation, the hydraulic cylinder 136 is pinned or restrained in some manner at the base 138 and the rig floor 142. The hydraulic cylinder 136 is then arranged to be connect between the base 138 and the rig floor 216, to push the rig floor 216 upwards from the intermediate center section 140, in a first operation, and then complete the raising of the rig floor 142 by raising the intermediate section in a second operation.

The pivotable links 146*b* and 146*c* are pinned between the rig floor 216, the intermediate center section 140, and the pivotable links 146*e* and 146*f* are pinned as shown. The process may then proceed in two steps, as described above, until both sections 140 are fully extended. As previously indicated, when the floor section 216 is fully extended from the intermediate center section 40 before it extends, it is shifted a noticeable distance to the left, as viewed. Again this shifting at the intermediate stage will be compensated by a near equal rightward shift the intermediate center section 140 is extended from the rig base 138. Once the rig floor 216 is fully extended above the intermediate center section 140, the links 146*a*, 146*b*, 146*c*, 146*d*, 146*e*, and 146*f* are re-arranged in a manner such the rig floor 142 is locked in an extended position with respect to the intermediate center section 140.

Those skilled in the art would appreciate that the height raised per lift section is related to the length of the individual links (46*a*, 46*b*, 46*c*, 46*d*, 46*e*, 46*f*, 46*g*, 46*h*, 46*i*, 46*j* and 46*k*—and/or 146*a*, 146*b*, 146*c*, 146*d*, 146*e*, and 146*f*) and their 'stack height'. Therefore, this same type of structure could be expanded to include three, or four or more lift sections, as required. This would allow for much greater flexibility in rig design, and allow common sized linkage members over a wide range of different drill rig sizes and types.

Furthermore, drill rig floors of this new design are structurally lighter, they may be shorter in length, and be movable in fewer pieces than conventional portable drill rigs, enabling them to access drilling areas with hilly, winding roads, as are often encountered in mountainous areas.

Whereas the present invention has been described in particular relation to the drawings attached hereto, it should be understood that other and further modifications apart from those shown or suggested herein, may be made within the scope and spirit of the present invention.

What is claimed is:

1. A substructure of a drill rig, the substructure comprising:

a base;

an intermediate section that is adapted to be raised above said base, wherein said intermediate section is further adapted to be laterally moved in a first lateral direction relative to said base and maintained substantially parallel to said base during said raising of said intermediate section above said base;

a rig floor section that is adapted to be raised above said intermediate section, wherein said rig floor section is further adapted to be laterally moved in a second lateral direction relative to said base and maintained substantially parallel to said base during said raising of said rig floor section above said intermediate section, said second lateral direction being substantially opposite to said first lateral direction; and a hydraulic cylinder apparatus that is adapted to be pivotably connected to at least said base, said hydraulic cylinder apparatus being adapted to raise at least one of said intermediate section above said base and said rig floor section above said intermediate section.

2. The substructure of claim 1, further comprising a first plurality of pivotable links each of which is pivotally connected to said base and said intermediate section, wherein said first plurality of pivotable links is adapted to laterally move said intermediate section in said first lateral direction and to maintain said intermediate section substantially parallel to said base during said raising of said intermediate section above said base.

3. The substructure of claim 2, wherein said first plurality of pivotable links is adapted to laterally move said rig floor section in said first lateral direction with said intermediate section.

4. The substructure of claim 2, further comprising a second plurality of pivotable links each of which is pivotally connected to at least said rig floor section, wherein said second plurality of pivotable links is adapted to laterally move said rig floor section in said second lateral direction and to maintain said rig floor section substantially parallel to said base during said raising of said rig floor section above said intermediate section.

5. The substructure of claim 4, wherein each of said second plurality of pivotable links is pivotally connected to said intermediate section.

6. The substructure of claim 4, wherein said first plurality of pivotable links is adapted to laterally move said intermediate section a first distance in said first lateral direction and said second plurality of pivotable links is adapted to laterally move said rig floor section a second distance in said second lateral direction, said second distance being substantially the same as said first distance.

7. The substructure of claim 4, further comprising a lift section that is operatively coupled between said intermediate section and said rig floor section, wherein said lift section is adapted to be raised above said intermediate section.

8. The substructure of claim 7, further comprising a third plurality of pivotable links each of which is pivotally connected to said lift section and said intermediate section, wherein said third plurality of pivotable links is adapted to laterally move said lift section in one of said first and second lateral directions during said raising of said lift section and to maintain said lift section substantially parallel to said intermediate section and said base during said raising of said lift section above said intermediate section.

9. The substructure of claim 1, wherein said rig floor section is adapted to be raised above said base with said intermediate section.

10. The substructure of claim 1, wherein said hydraulic cylinder apparatus is adapted to be pivotably connected to said intermediate section so as to raise said intermediate section above said base, said hydraulic cylinder apparatus being further adapted to be pivotably connected to said rig floor section so as to raise and said rig floor section above said intermediate section.

11. The substructure of claim 1, further comprising at least one pivotable link that is adapted to lock said intermediate section in a raised position after said intermediate section has been raised above said base, said at least one pivotable link having a first end that is adapted to be pivotably connected to one of said intermediate section and said base and a second end that is adapted to be connected to the other one of said intermediate section and said base after said intermediate section has been raised to said raised position.

12. The substructure of claim 1, further comprising at least one pivotable link that is adapted to lock said rig floor section in a raised position after said rig floor section has been raised above said intermediate section, said at least one pivotable link having a first end that is adapted to be pivotably connected to one of said rig floor section and said intermediate section and a second end that is adapted to be connected to the other one of said rig floor section and said intermediate section after said rig floor section has been raised to said raised position.

13. The substructure of claim 1, wherein said intermediate section is adapted to be raised above said base before said rig floor section is raised above said intermediate section.

14. The substructure of claim 1, wherein said rig floor section is adapted to be raised above said intermediate section before said intermediate section is raised above said base.

15. A method for raising a substructure of a drill rig, the method comprising:

raising an intermediate section of said substructure above a base of said substructure;

during said raising of said intermediate section above said base, laterally moving said intermediate section in a first lateral direction relative to said base while maintaining said intermediate section substantially parallel to said base;

raising a rig floor section of said substructure above said intermediate section; and during said raising of said rig floor section above said intermediate section, laterally moving said rig floor section in a second lateral direction relative to said base while maintaining said rig floor section substantially parallel to said intermediate section and said base, said second lateral direction being substantially opposite to said first lateral direction.

16. The method of claim 15, further comprising:

pivotally connecting each of a first plurality of pivotable links to said base and said intermediate section and, during said raising of said intermediate section, using said first plurality of pivotable links to laterally move said intermediate section in said first lateral direction and to maintain said intermediate section substantially parallel to said base; and pivotally connecting each of a second plurality of pivotable links to at least said rig floor section and, during said raising of said rig floor section, using said second plurality of pivotable links to laterally move said rig floor section in said second lateral direction and to maintain said rig floor section substantially parallel to said intermediate section and said base.

17. The method of claim 16, further comprising pivotally connecting each of said second plurality of pivotable links to said intermediate section.

18. The method of claim 15, further comprising pivotally connecting at least one pivotable link to one of said intermediate section and said base and, after raising said intermediate section to a raised position above said base, connecting said at least one pivotable link to the other one of said intermediate section and said base to lock said intermediate section in said raised position.

19. The method of claim 15, further comprising pivotally connecting at least one pivotable link to one of said rig floor section and said intermediate section and, after raising said rig floor section to a raised position above said intermediate section, connecting said at least one pivotable link to the other one of said rig floor section and said intermediate section to lock said rig floor section in said raised position.

20. The method of claim 15, wherein raising said intermediate section above said base comprises raising said rig floor section with said intermediate section.

21. The method of claim 15, wherein said intermediate section is raised above said base before said rig floor section is raised above said intermediate section.

22. The method of claim 15, wherein said rig floor section is raised above said intermediate section before said intermediate section is raised above said base.

23. The method of claim 22, wherein raising said lift section above said intermediate section comprises raising said rig floor section with said lift section.

24. The method of claim 15, wherein laterally moving said intermediate section in said first lateral direction comprises moving said intermediate section a first lateral distance and wherein moving said rig floor section in said second lateral direction comprises moving said rig floor section a second lateral distance that is substantially the same as said first lateral distance.

25. The method of claim 15, further comprising:

operatively coupling a lift section between said intermediate section and said rig floor section;

raising said lift section above said intermediate section; and during said raising of said lift section above said intermediate section, laterally moving said lift section in one of said first and second lateral directions while maintaining said lift section substantially parallel to said intermediate section and said base.

26. The method of claim 15, wherein raising said substructure comprises raising a drilling rig mast that is operatively coupled to said substructure.

27. A substructure of a drill rig, the substructure comprising:

a base;

an intermediate section that is adapted to be raised above said base, wherein said intermediate section is further adapted to be laterally moved in a first lateral direction relative to said base and maintained substantially parallel to said base during said raising of said intermediate section above said base; and a rig floor section that is adapted to be raised above said intermediate section after said intermediate section is raised above said base, wherein said rig floor section is further adapted to be laterally moved in a second lateral direction relative to said base and maintained substantially parallel to said base during said raising of said rig floor section above said intermediate section, said second lateral direction being substantially opposite to said first lateral direction.

28. A substructure of a drill rig, the substructure comprising:

a base;

an intermediate section that is adapted to be raised above said base, wherein said intermediate section is further adapted to be laterally moved in a first lateral direction relative to said base and maintained substantially parallel to said base during said raising of said intermediate section above said base; and a rig floor section that is adapted to be raised above said intermediate section before said intermediate section is raised above said base, wherein said rig floor section is further adapted to be laterally moved in a second lateral direction relative to said base and maintained substantially parallel to said base during said raising of said rig floor section above said intermediate section, said second lateral direction being substantially opposite to said first lateral direction.

* * * * *